US006709371B2

(12) United States Patent
Wu

(10) Patent No.: US 6,709,371 B2
(45) Date of Patent: Mar. 23, 2004

(54) HANDY WEIGHT FOR EXERCISING

(76) Inventor: Hsin-Yuan Wu, No. 6, Lane 57, Tai-Chang-Erh St., Taoyuan City (TW)

( * ) Notice: Subject to any disclaimer, the term of this patent is extended or adjusted under 35 U.S.C. 154(b) by 202 days.

(21) Appl. No.: 09/962,185

(22) Filed: Sep. 24, 2001

(65) Prior Publication Data

US 2003/0060346 A1 Mar. 27, 2003

(51) Int. Cl.[7] ..... A63B 21/075
(52) U.S. Cl. ..... 482/108; 482/106
(58) Field of Search ..... 482/93, 106, 107, 482/108

(56) References Cited

U.S. PATENT DOCUMENTS 1,316,683 A * 9/1919 Calvert ..... 482/93
2,577,343 A * 12/1951 Martin ..... 446/325
2,939,707 A * 6/1960 Lemelson ..... 273/402
4,079,932 A * 3/1978 Schuetz ..... 482/82
4,440,111 A * 4/1984 Meyer ..... 119/61
5,496,244 A * 3/1996 Caruthers ..... 482/108

* cited by examiner

*Primary Examiner*—Nicholas D. Lucchesi
*Assistant Examiner*—Tam M. Nguyen
(74) *Attorney, Agent, or Firm*—William E. Pelton, Esq.

(57) ABSTRACT

A handy weight for exercising is disclosed. The handy weight includes a hollow body having a top handle and a convex bottom. The body is formed with a handhole for a user to grip the handle. Furthermore, the handy weight has a fixed center of gravity sufficiently low enough to enable the body to define a stable equilibrium position, in which the handle is at the top of the body, and enable the body to recover to the stable equilibrium position after being placed away from the position on a bearing surface.

5 Claims, 5 Drawing Sheets

HANDY WEIGHT FOR EXERCISING

BACKGROUND OF THE INVENTION

1. Field of the Invention

The present invention relates to a handy weight for exercising and, more particularly, to such a handy weight which is easy to be taken up and safe during exercising.

2. Description of Related Art

Handy weights such as dumbbells are well known. The dumbbells are so small that they can be used for exercising either indoors or outdoors. Yet the dumbbells have an unattractive appearance and are awkward to be handled. Additionally, they are generally made of metal, especially cast-iron, a hard material which would do considerable harm to the furniture or even to the exercisers themselves when the dumbbell is dropped accidentally.

A handy weight in a ball-like configuration is also known. As shown in FIGS. 3 and 4, this handy weight is configured as a substantially spherical body (90) having a handle (94) and a handhole (92) for the hand to enter to grip the handle (94). Furthermore, the body (90) is hollow and made of plastic, including the part forming the handle (94). The hollow body (90) may be filled with sand (96) fully or partially, via a bottom aperture (99) which is then closed by a plug (990). The amount of sand varies depending on the weight which the exerciser needs.

The ball-like handy weight provides an appealling design, and its plastic body (90) is harmless even in an actual collision.

However, it has been found that the spherical body (90) will roll on the floor or ground before coming to rest in a random position, i.e. without the handle (94) being at the uppermost, as illustrated in FIG. 5, which makes the handy weight less easy to be taken up at the next turn. Even though a plurality of bosses (98) is provided in the body (90) in a location opposed to the handle, as shown in FIG. 4, the bosses (98) will not function unless the spherical body (90) has been placed down carefully and is kept motionless after then.

A more serious problem about the ball-like handy weight is that the exerciser is often injured at the wrist when performing an exercise that involves rapid arm-swinging. This is because the movable sand in the hollow body (90) quickly and unexpectedly changes the center of gravity of the whole handy weight such that the exerciser can hardly adjust to the change.

A further problem about the ball-like handy weight is that the fingers of the exerciser may be jammed uncomfortably in the handhole (92), as a result of the hollow handle (92) which will be deformed and will reduce the dimension of the opening (92) as the handy weight is lifted.

Therefore, it is an objective of the invention to provide a handy weight to mitigate and/or obviate the aforementioned problems.

SUMMARY OF THE INVENTION

The object of the present invention is to provide a handy weight which is easy to be taken up.

Another object of the present invention is to provide a handy weight which is safe during exercising.

Other objects, advantages and novel features of the invention will become more apparent from the following detailed description when taken in conjunction with the accompanying drawings.

DETAILED DESCRIPTION OF THE PREFERRED EMBODIMENT

Figure 1:
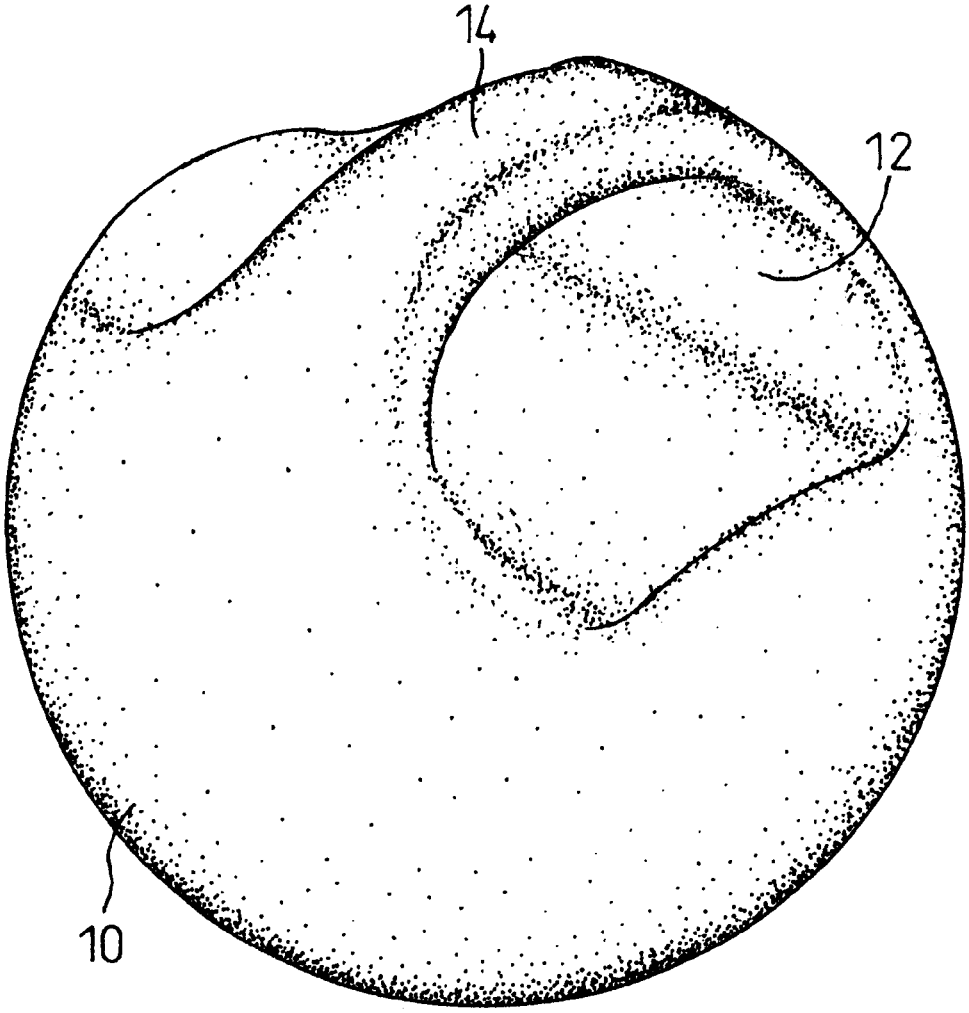
FIG. 1 is a perspective view of a preferred embodiment of a handy weight in accordance with the present invention.

Referring to FIG. 1, there is shown a preferred embodiment of a handy weight in accordance with the present invention for exercising the muscles, especially those of the arm.

The handy weight, preferably made of rubber, is configured as a substantially spherical body (10) having a top handle (14) and a convex bottom (not numbered), with a handhole (12) provided for a hand to enter to grip the handle (14).

Figure 2:
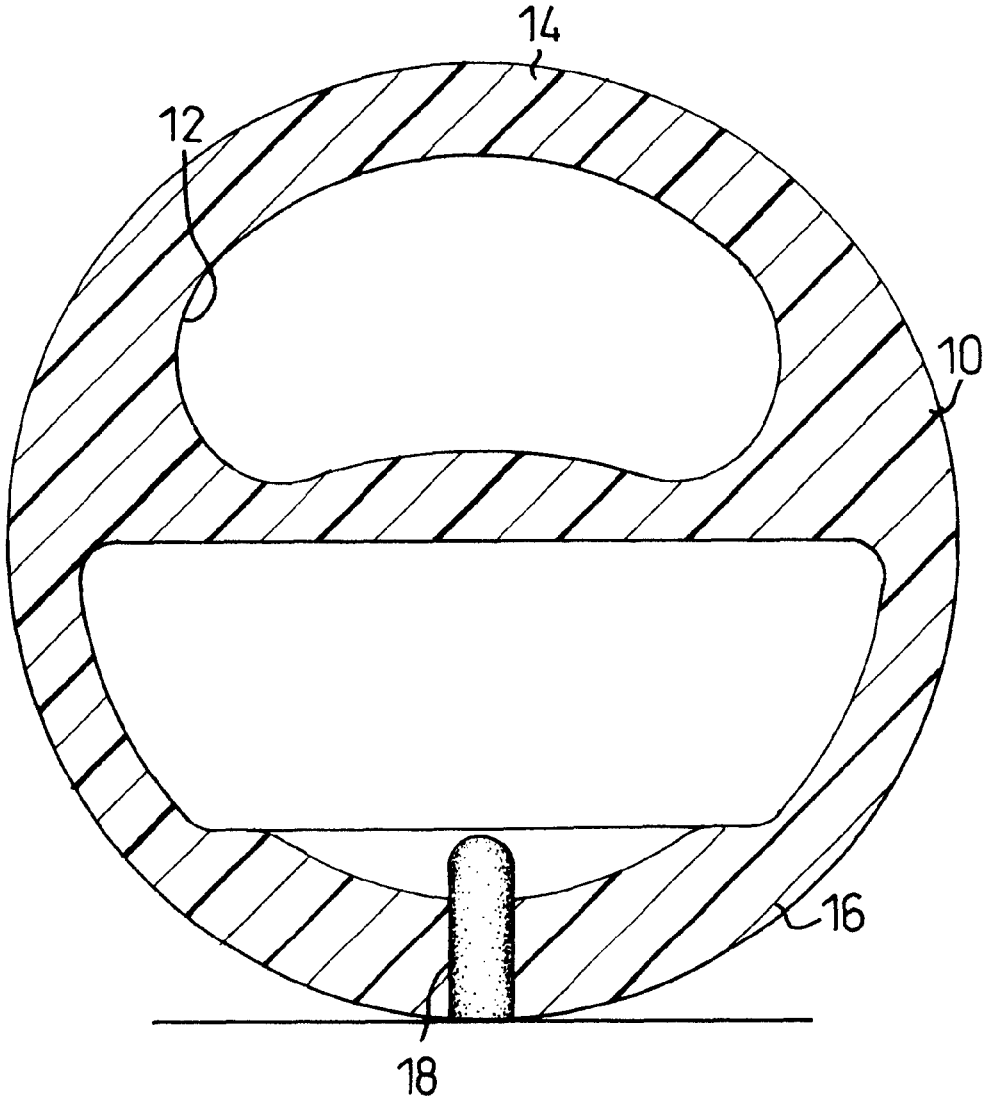
FIG. 2 is a cross-sectional view of the handy weight shown in FIG. 1.
Figure 3:
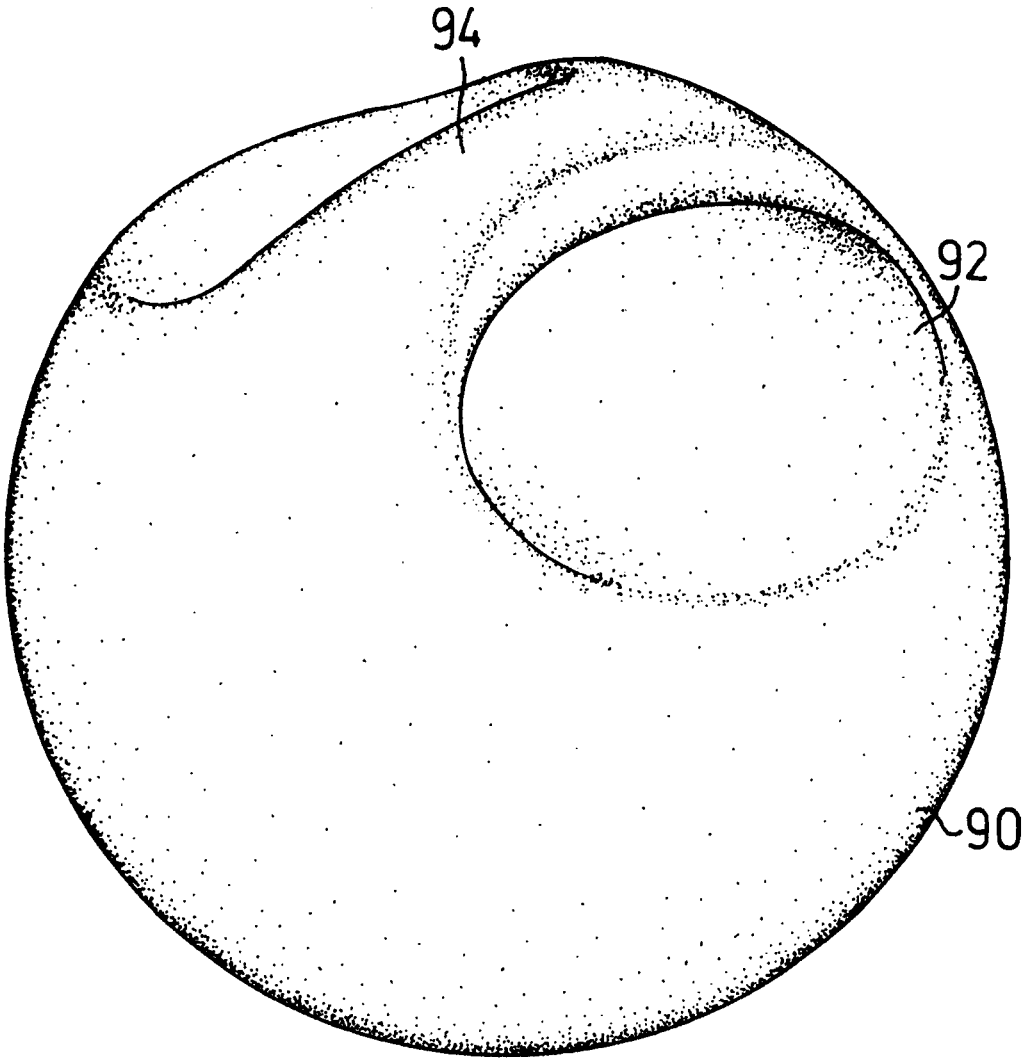
FIG.3 PRIOR ART
FIG. 3 is a perspective view of a ball-like handy weight of a conventional type.
Figure 4:
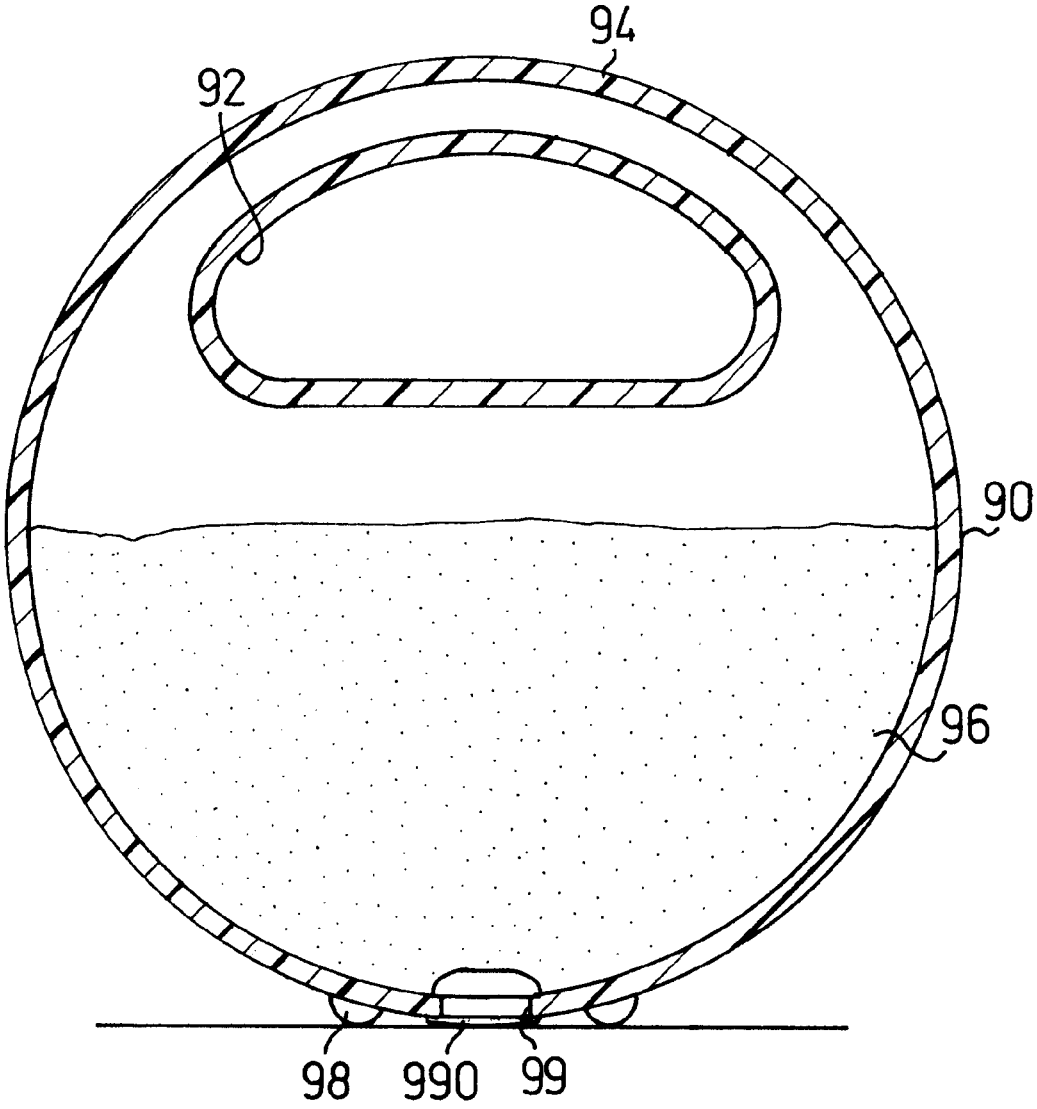
FIG.4 PRIOR ART
FIG. 4 is a cross-sectional view of the handy weight of FIG. 3, showing a handle at an uppermost position.
Figure 5:
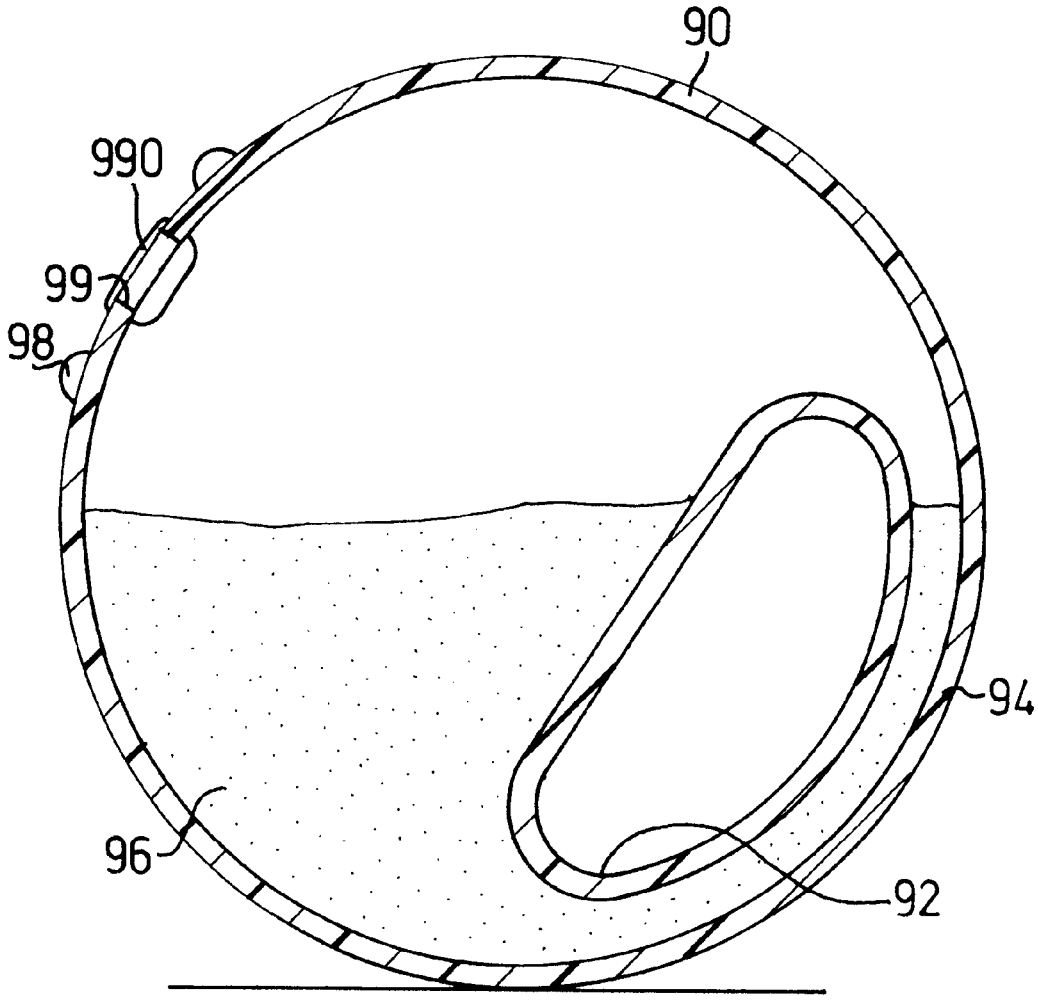
FIG.5 PRIOR ART
FIG. 5 is a cross-sectional view of the handy weight of FIG. 3, showing the handle away from the uppermost position.

Referring to FIG. 2, the handle (14) is solid but the body (10) is hollow. The hollow body (10) additionally has a vent (18) formed in its convex bottom in communication with both the interior and the exterior of the hollow body (10).

More importantly, the hollow body (10) has such a thick wall (16) about the convex bottom that the whole handy weight is provided with a fixed center of gravity which is sufficiently low enough to enable the body (10) to define a stable equilibrium position, in which the handle (14) is at the uppermost position in comparison to the rest of the body (10), as shown in FIG. 2.

In other words, this low center of gravity enables the body (10) to recover to the stable equilibrium position sooner or later after the body (10) is placed away from the position on a bearing surface, thereby facilitating a user to easily grasp and lift the handy weight.

From the above description, it is noted that the invention has the following advantages:

1. Being Easy to be Taken up

Because of the ability of the body (10) to recover to its stable equilibrium position, it is easy for the exerciser to take up the handy weight.

2. Being Safe During Exercising

Because of the fixed center of gravity and the solid handle (14), the exerciser will neither be injured at the wrist during rapid arm-swinging, nor experience jamming of fingers in the handhole (12) while lifting the inventive handy weight.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A handy weight for exercising, comprising:

a hollow body having a top handle, and a convex bottom, said body being formed with a thick wall portion relative to remaining wall structure about said convex bottom and a handhole for a user to grip said handle; and wherein said thick wall provides a fixed center of gravity sufficiently low enough to enable said body to define a stable equilibrium position in which said handle is at an uppermost position and to enable said body to recover to said stable equilibrium after being placed away from said position on a bearing surface.

2. The handy weight as claimed in claim 1, wherein said hollow body is spherical in shape.

3. The handy weight as claimed in claim 1, wherein said hollow body is made of rubber.

4. The handy weight as claimed in claim 1, wherein said handle is solid.

5. The handy weight as claimed in claim 1, wherein said hollow body is formed in said convex bottom with a vent in communication with an interior of said hollow body and an exterior of said hollow body.

* * * * *